United States Patent [19]

Rubin

[11] Patent Number: 4,486,016

[45] Date of Patent: Dec. 4, 1984

[54] TOY PUNCHING BAG SUPPORT CONSTRUCTION

[75] Inventor: Herbert Rubin, New York, N.Y.

[73] Assignee: New York Toy Corporation, Lawrence, Mass.

[21] Appl. No.: 430,209

[22] Filed: Sep. 30, 1982

[51] Int. Cl.[3] ..... A63B 69/00

[52] U.S. Cl. ..... 272/78

[58] Field of Search ..... 272/76, 77, 78; 273/26 R, 29 A

[56] References Cited

U.S. PATENT DOCUMENTS 3,022,072 2/1962 Zinnow ..... 272/78

3,967,822 7/1976 Candor et al. ..... 273/26 R

FOREIGN PATENT DOCUMENTS 1325472 6/1962 France ..... 272/78

OTHER PUBLICATIONS

New York Toy Catalog, pp. 9 and 10, 1981.

*Primary Examiner*—Richard C. Pinkham

*Assistant Examiner*—T. Brown

*Attorney, Agent, or Firm*—Wolder, Gross & Yavner

[57] ABSTRACT

An improved toy punching bag support construction to substantially increase the utility of the toy to the user. Its base support is hollow and can be filled via removable plug with sand or water to significantly increase the weight of the support. The added weight allows the user to punch and circle the bag without having to stand in a stationary position on a support base to secure the bag. A flexible vertical rod has an upper end connected to the bottom end of the bag. The lower end of the rod is adjustably mounted in a pipe. The pipe extends into a sleeve and is fixed relative to the sleeve by a threaded nut at the bottom and a welded stop at the top. The sleeve extends vertically through the base support and has upper and lower shoulders spaced inwardly from the top and bottom walls of the base support.

3 Claims, 2 Drawing Figures

TOY PUNCHING BAG SUPPORT CONSTRUCTION

This invention relates primarily to a toy punching bag, and more particularly to the support base used to retain the punching bag in an upright operative condition.

BACKGROUND OF INVENTION

The use of toy punching bags for entertainment and to develop coordination in children has been well known in the toy art for many years. For example, the toy set offered by the New York Toy Corporation has been in their model line for approximately thirty years. The item, which is unchanged in all that time, basically consists of a toy punching bag secured to the upper end of a flexible steel rod. The rod is received within an adjustable securement member which in turn is rigidly secured to a base. The child stands on the base and punches the bag. The purpose of the base is to make certain that the bag stays in an upright operative condition. If the child were to move off the base, it is quite possible that the minute a child would hit the bag, especially from an angle that would be acute to the principal axis of the base, the whole unit would topple on its side.

Thus, the bag is limited in use so that the child can only stand or crouch in one single position in attacking the bag, with most of the radius of the bag untouched.

The child would always be conscious of the fact that he or she has to stand on the base, and this has certainly led to disturbance of the intent to develop some type of coordination, which is one of the principal reasons for using a punching bag. Even if the child were to circle to the side of the bag, at least one foot must be on the base at all times, and the child would always be conscious of this fact, namely that either one or two feet have to be planted firmly on the base.

Accordingly, it is a primary object of the present invention is to provide an improved punching bag support construction which will allow much more versatile use by the child.

A further object of the present invention is to provide a punching bag support construction of the character described in which the base support is sufficient in itself to retain the punching bag in its upright operative condition without further assistance from the body weight of the user.

Yet a further object of the present invention is to provide a support construction of the character described in which the user is capable of concentrating solely on developing boxing skills and coodination controls, without having to be concerned about providing sufficient weight to assist in support of the bag.

Still yet another object of the present invention is to provide an improved toy punching bag support construction which will allow the user to completely circle around the full 360° radius of the bag.

Yet still a further object of the present invention is to provide an improved support construction which is much safer than the present art, since it is not likely to fall, twist, or otherwise cause unexpected movement or get entangled with the body of the user.

A still further and significant object of the present invention is that the support construction is inexpensive to manufacture, and yet is durable to a high degree in use.

BRIEF DESCRIPTION OF INVENTION AND DRAWINGS

These and other objects of the present invention are provided in an improved toy punching bag support construction in which the lower end of a flexible rod is received within an adjustable member which is secured within a hollow base support having sufficient interior volume so that if either water or sand is placed therein, the added weight is sufficient by itself to support the punching bag and the flexible support rod without any further assistance from the body weight of the user. The base support has a replaceable plug on the top wall to allow filling and emptying of the interior of the base. The flexible support is supported on the bottom wall of the base support in the usual manner, and has an addition and passes through a centrally located sleeve within the base support. The top wall also has means to maintain the pipe securement means in stationary position.

For the first time, the user of the toy punching bag is able to circle around the full 360° of the bag, and to concentrate solely on punching skills and coordination, without having to be concerned in the back of his or her mind about providing additional weight to insure the proper support of the bag.

Other objects, features and advantages of the present invention will become apparent by reference to the following detailed description of a preferred, but nonetheless illustrative, embodiment of the present invention, with reference to the accompanying drawings, wherein:

FIG. 1 is a perspective view of a user hitting the punching bag, retained in position by the improved base support; and FIG. 2 is a significantly enlarged, partial, cross-sectional view taken along lines 2—2 of FIG. 1.

DETAILED DESCRIPTION OF THE INVENTION

Figure 1:
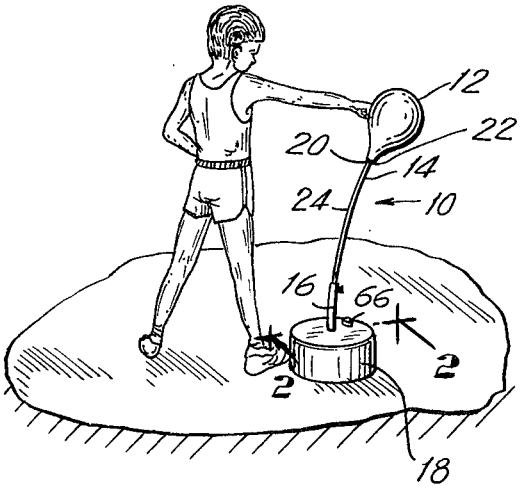

Referring to the drawings and more particularly to FIG. 1, there is shown an improved child's punching bag unit 10 which includes a punching bag 12, a flexible support rod 14, and an adjustable pipe securement means 16 positioned within a base support 18.

Figure 2:
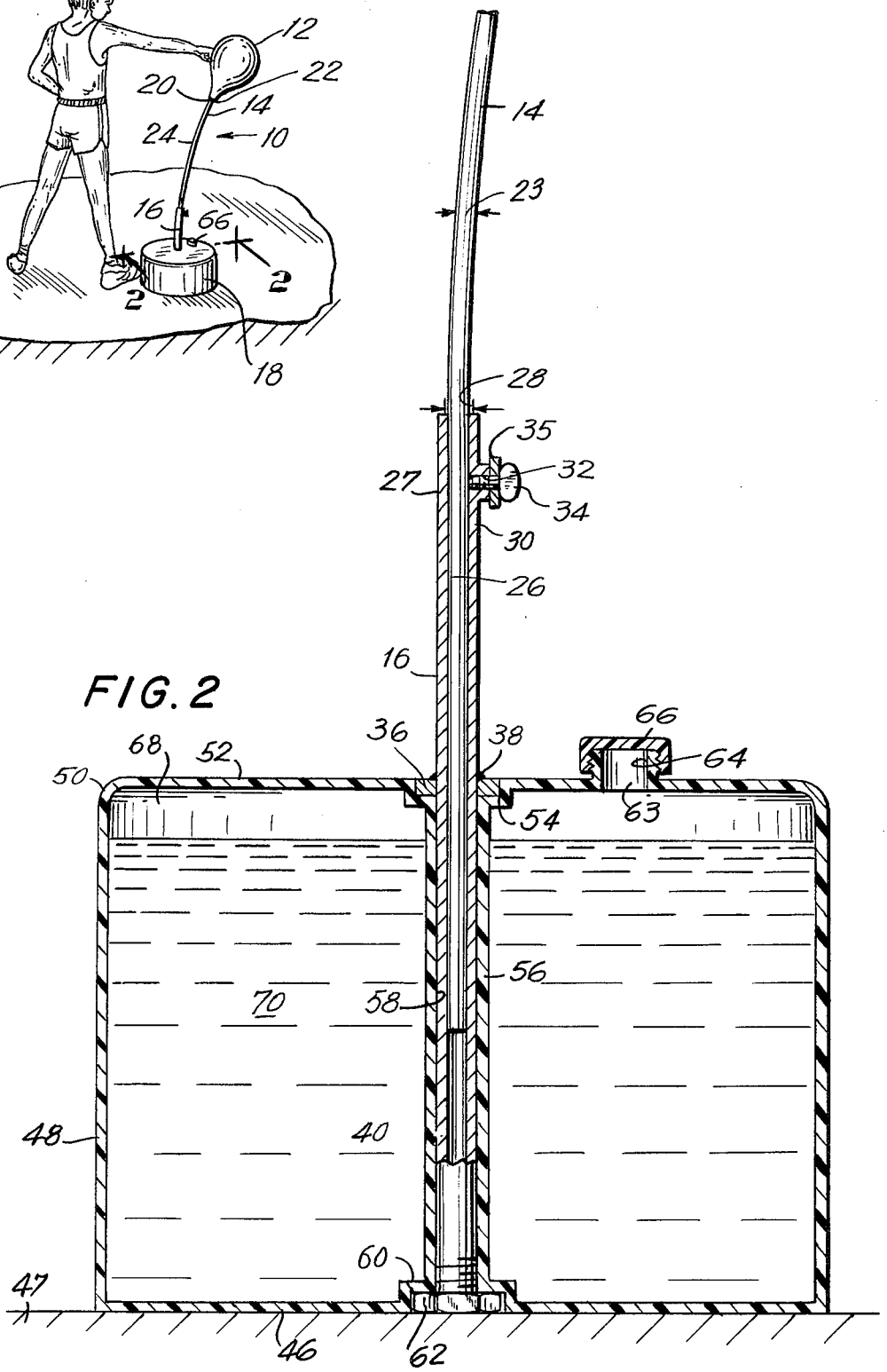

Turning more specifically to the punching bag, it is of a standard construction and has a lower opening 20 within which is received the upper end 22 of rod 14. The rod has a consistent diameter 23 (FIG. 2) which is continued throughout its middle portion 24 and into its base portion 26. The rod is of sufficient length so that the height of the bag above the horizontal support surface, such as a floor, can be varied from 36 to 46 inches in the manner hereinafter appearing.

The adjustable pipe securement means 16 includes a hollow pipe member 27 defined by an inner diameter 28 which is just slightly larger than the diameter 23 of the flexible support rod 14. At the upper end 30 there is positioned a perpendicular threaded bore 32 receiving a threaded wing bolt 34 and lock nut 35 within the bore.

At the point the pipe member 27 is received within the body of the base support 18, there is a positioning washer 36 held in place by a weld beads 38. In the same manner the lower end 40 of the pipe member is positioned adjacent to a threaded nut 62 that may be secured by means of glue or welding and the exposed end 44 will be positioned as hereinafter described.

The base support 18 is essentially cylindrical in configuration and is defined by a circular bottom wall 46 which rests upon a horizontal support surface 47, such as a floor. Depending upwardly from the wall 46 is a cylindrical side wall 48 meeting an upper rounded shoulder 50 and meeting a circular top wall 52. At the center of the unit and the top wall is an upper annular recessed shoulder 54 which receives the sustaining washer 36. The shoulder terminates in a central sleeve 56 which extends downwardly through the entire center of the support and is defined by an inner surface 58 which receives the pipe member 27. The sleeve ends in a lower annular recessed shoulder 60 which then merges with the base wall 46.

The lower end 40 of the pipe member 27 extends beyond the recess and terminates flush with the lower surface of the bottom wall 46, the exposed outer surface of member 27 being threaded. This allows the securement of standard nut 62 threaded unto the exposed surface.

Located in the top wall 52 there is an opening 63 around which is secured an upwardly standing threaded shoulder 64 which receives a mating threaded plug 66.

In use, to assemble the toy it is simply necessary to place the washer 36 around the pipe member 27 until it meets the beads 38. Then the pipe member is slipped into the sleeve 56 with the nut placed in the lower annular recess 60 and tightened to secure it properly. Then the plug 66 is removed and either water or sand are poured into the interior of the base support filling the interior volume 68 with sand or water 70. At that point, the punching bag may be placed on the upper end 22 of the flexible support rod 14, the lower end being placed within the pipe and secured therein by means of the wing bolt 34 in the usual manner. The user may then play with the punching bag, developing further boxing skills and coordination in the well known manner, allowing complete and sole concentrations on these efforts, with no concentration or side effort required to maintain the base support by means of placing the body weight of the user on the base support. The bag may be approached from all 360° surrounding it, thus providing a professional aura.

While the structure and convenience of the present invention has been described herein, variations of use and construction are still within the scope of the invention if within the limits of the following claims:

I claim:

1. An improved toy punching bag support construction which comprises:

a. a punching bag having a lower opening;

b. a flexible support rod having an upper end and a lower end; the punching bag being secured to the upper end thereof, the rod being of sufficient length;

c. a base support having a top wall, a bottom wall and a side wall defining an inner space, and having an inner sleeve passing from the top wall to the bottom wall, the sleeve having upper and lower annular recess shoulders depending inwardly from the top and bottom walls respectively;

d. adjustable securement means removably secured to the base support and having a rigid securement member received within the sleeve of the base, stop means positioned along the length of the securement means, the lower end of the securement means being externally threaded;

e. a washer received within the upper annular recessed shoulder on the top wall of the base support, the securement means passing through a central opening in the upper annular shoulder and then through the sleeve, the stop means abutting against the annular shoulder at such a position that the lower threaded portion of the securement means is co-extensive with the bottom wall of the base support, an internally threaded nut rigidly secured within the lower annular recess shoulder in the bottom wall of the base support, adapted to receive the threaded lower portion of the securement means;

f. adjustable retaining means positioned within the securement means to allow variable positioning of the flexible support rod within a sufficient variation of heights to accommodate the needs of a young person; and g. a reclosable opening located within one of the walls of the base support so that the hollow inner space may be filled with a ballast to provide sufficient weight for free standing use of the construction as a punching bag;

h. whereby the unit may be easily assembled in a strong rigid and useful condition, and may be as easily dissembled with little effort.

2. The invention according to claim 1, the stop means being welded beads.

3. The invention according to claim 1, the adjustable retaining means including a bore in the securement means perpendicular to the central axis thereof, the bore having an internal thread, a threaded wing nut being positioned within the bore and bearing against the rod to retain the same at a desired height.

* * * * *